United States Patent [19]

Howarth, Jr.

[11] 4,161,266

[45] Jul. 17, 1979

[54] LIFELINE CARRIER

[76] Inventor: William F. Howarth, Jr., 48 Ashland Ave., Methuen, Mass. 01844

[21] Appl. No.: 738,713

[22] Filed: Nov. 4, 1976

[51] Int. Cl.[2] ..... A45C 11/00

[52] U.S. Cl. ..... 224/215; 182/3; 182/100

[58] Field of Search ..... 224/5 R, 5 A, 5 B, 5 F, 224/5 W, 25 R, 25 A, 26 R, 26 B, 26 K; 206/525, 527; 242/85.1; 9/14; 248/79, 89, 311.1; 182/3, 70, 100, 189, 190; 239/152, 153, 154; 221/91, 92

[56] References Cited

U.S. PATENT DOCUMENTS

| | | | |
|---|---|---|---|
| 2,517,118 | 8/1950 | Lee | 242/85.1 X |
| 2,630,651 | 3/1953 | McGee | 224/26 R X |
| 2,753,100 | 7/1956 | Montgomery | 224/5 A X |
| 3,250,448 | 5/1966 | Clark | 224/5 R X |
| 3,269,129 | 8/1966 | Zambrano | 224/25 A X |
| 3,378,222 | 4/1968 | Erickson | 248/89 X |
| 3,409,192 | 11/1968 | Scott | 224/25 A |
| 3,712,568 | 1/1973 | Grasso | 206/525 X |
| 3,828,856 | 8/1974 | Wallis | 206/527 X |
| 3,874,632 | 4/1975 | Rago | 182/3 X |
| 4,033,276 | 7/1977 | Barr | 242/85.1 X |

FOREIGN PATENT DOCUMENTS

| | | | |
|---|---|---|---|
| 465847 | 9/1928 | Fed. Rep. of Germany | 248/311.1 |
| 1121658 | 7/1968 | United Kingdom | 9/14 |

*Primary Examiner*—Trygve M. Blix
*Assistant Examiner*—Winston H. Douglas
*Attorney, Agent, or Firm*—Pearson & Pearson

[57] ABSTRACT

An elongated life line for firemen is back carried in an elongated tubular container attachable on, and detachable from a back carried air tank. The rope container has a latched, spring-opened closure at its bottom, accessible to the fireman by reaching behind his back. By pulling on a pigtail or on one swivel hook end of the rope, the unitary package of coiled rope is quickly released slide as a unit out of the bottom of the container for use. A flexible resilient blade on the rope container is slid down behind the encircling strap of the air tank and its lower end latched to the container.

8 Claims, 4 Drawing Figures

LIFELINE CARRIER

BACKGROUND OF THE INVENTION

Most fire trucks and fire men are provided with back pack air tanks for providing air to the fireman, or to fire victims during and after a fire. Such packs usually consist of a frame for resting on the upper back, suitable shoulder and waist straps, a cylindrical air tank usually inverted with the outlet at the bottom and at least one relatively wide flexible, resilient metal strap, encircling the tank midway of its height, for detachably mounting the tank on the frame.

If the fireman is to also carry a lifeline, which is usually fifty feet of quarter inch nylon with a tensile strength of at least one thousand pounds, it has been necessary for the fireman to wrap the line in convolutions around his waist. If not so carried, the usual life line, which is always carried into a burning building, is carried as a coil with the end wrapped around the coil and inserted into the loops and such a line not only requires both hands to uncoil and use but consumes considerable valuable time in uncoiling.

It has been proposed to festoon coil a hose in a fixed container for withdrawal through a front door as in U.S. Pat. No. 2,517,118 to Lee of Aug. 1, 1950.

It has also been proposed to festoon coil a blasting cap wire within a cylindrical container, access being had to the coil by breaking the container along a transverse centre line as in U.S. Pat. No. 1,983,141 to McFarland of Dec. 4, 1934.

SUMMARY OF THE INVENTION

However, as far as I am aware there is no commercially available life line container for the use of firemen from which a length of line may be quickly and easily withdrawn with one hand during a fire and which can be carried in a convenient manner on the air tank the fireman is required to wear.

In this invention an elongated hollow tubular container of light weight material, such as thin walled plastic pipe, or the like, is closed at one end and open at the other end. A suitable length of Nylon rope is festoon coiled, or packed within the container, there being swivel hooks at each end, and one hook being close to the open end to fall out when the end closure is unlatches to spring open. A "pig tail" is preferably also arranged to fall out of the container. The container is provided with a flexible resilient blade of metal, or the like, one end being fixed to the container near the closed end so that the other free end of the blade may be slid downwardly behind the encircling strap of the air tank to position the container parallel to the tank with the open end at the level of the base of the tank.

Thus the fireman cannot forget the line because it is attached to his tank and he needs only to unlatch the bottom closure to withdraw the line slidable, as a unitary package, downwardly with one hand. The line thus is quickly accessible for the fireman to hold one end while dropping the other end out a window for hooking onto a hose and drawing the hose upwardly to fight the fire. The danger of a waist-wrapped rope, or a hand carried rope coil becoming entangled with furniture, dropped, lost or entangled with itself is overcome by the device of the invention.

DESCRIPTION OF A PREFERRED EMBODIMENT

Figure 1:
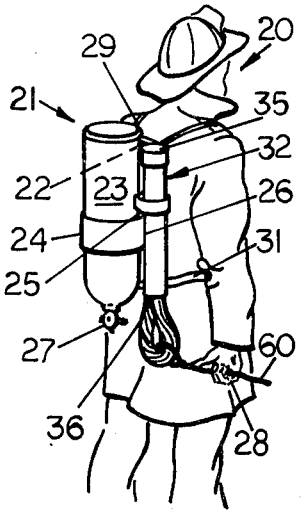
FIG. 1 is a rear perspective view of a fireman carrying a Compressed Air Tank on his back and with the life line carrier of the invention supported thereon.
Figure 2:
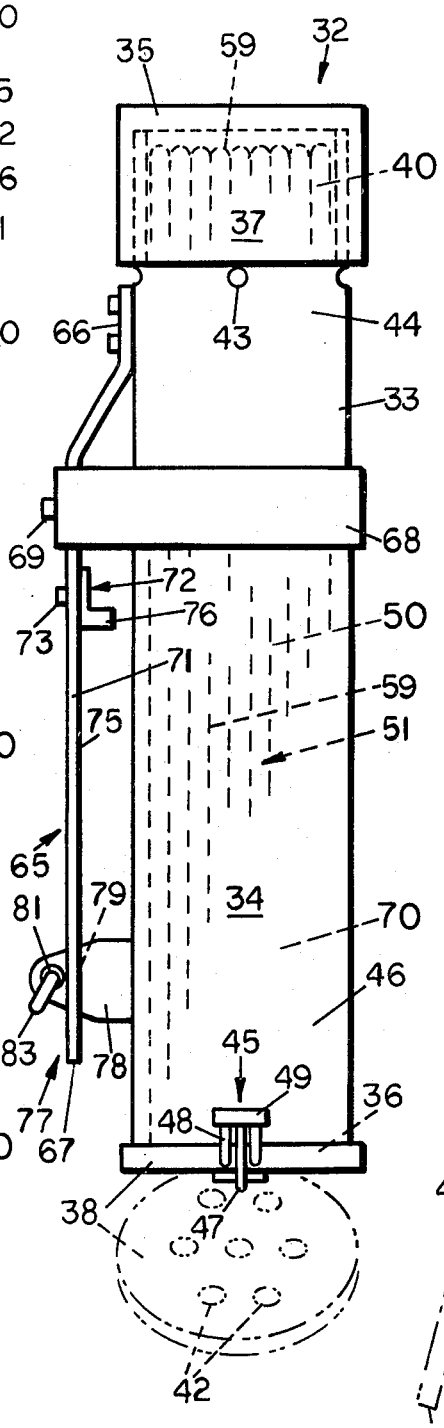
FIG. 2 is an enlarged side elevation of the life line carrier of the invention.
Figure 3:
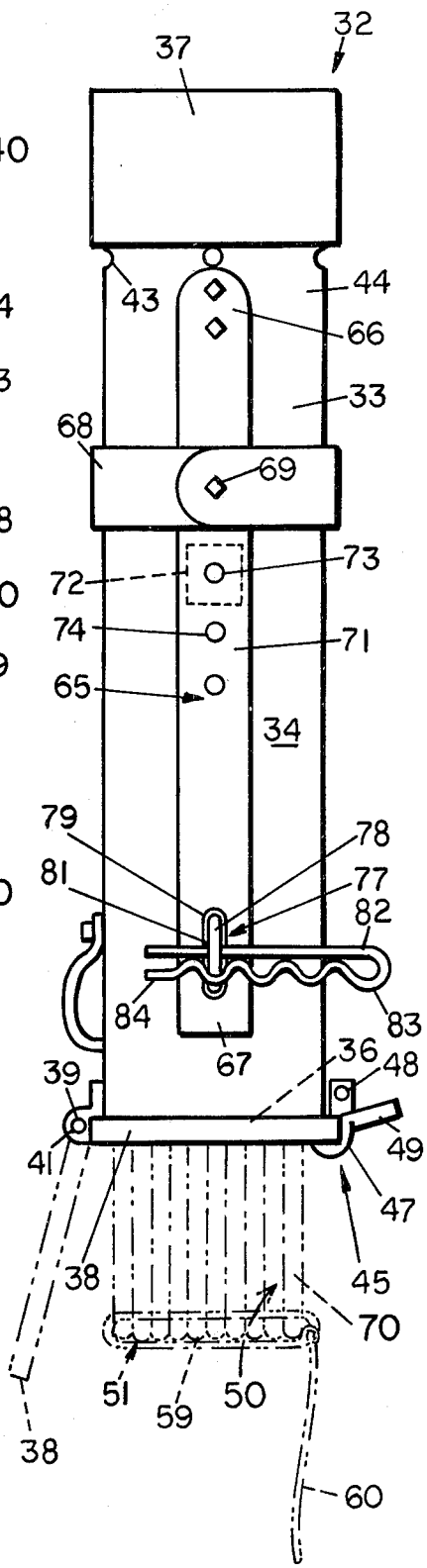
FIG. 3 is a rear elevation of the device shown in FIG. 2.

In FIG. 1, a fireman 20 is shown wearing a back pack 21 of a well known type much in use in this country and called a "Scott Pak". The pack 21 includes a frame 22, and an inverted air tank 23 held thereon by at least one strap 24 which partially encircles the cylinder 23 with a slight space, or clearance 25 therebetween especially at the tangential contact area 26. The inverted tank 23 has its outlet 27 at the bottom at about, or below, waist level, so that it can be reached by the hands 28 of the fireman. The back pack 21 is held in place by suitable shoulder straps 29, and waist straps 31.

The life line carrier 32 of the invention includes an elongated hollow tubular container 33, which is preferably cylindrical, and which has a hollow cylindrical side wall 34, made, for example, of thin-walled plastic pipe, or other self supporting material. Container 33 has a closed end 35 and an opposite open end 36, the end 35 being conveniently closed by a plastic cap 37 which may be threaded or heat fused in place or a plastic plug may be used.

An openable closure 38 is provided to cover the end 36, the closure 38 being hinge-pivoted at 39 to the portion of side wall 34 proximate the open end 36 and having a coil spring 41 for spring biasing the closure 38 to open position as shown in dotted lines.

Closure 38 is circular, when container 33 is cylindrical, and includes a plurality of vent holes 42 which cooperate with vent holes 43 in the portion 44 of side wall 34 proximate closed end 35 to prevent dry rot of the line.

First latch means 45 is provided at the open end 36, proximate lower portion 46 of side wall 34, comprising a latch detent 47 pivoted at 48 and having a handle 49. First latch means 45 retains the end closure 38 in closed position, until the handle 49 is moved to allow the closure to spring to open position.

Figure 4:
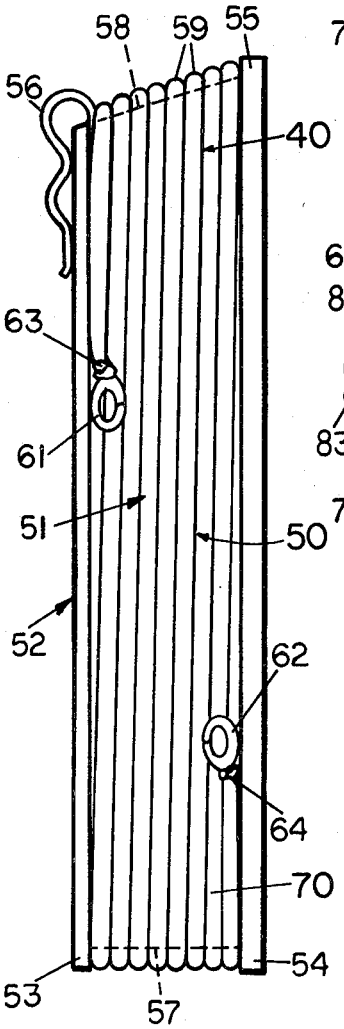
FIG. 4 is a side elevation of a reel for the line of the invention, the festoon coiled line being removed therefrom for insertion in the device.

An elongated line 51, preferably about fifty feet long, one quarter inch in diameter and of Nylon is festoon coiled on a flat reel 52 as shown in FIG. 4. The reel 52 includes axial projections 53, 54 and 55, and a removable cotter pin projection 56, thus defining end recesses 57 and 58 for retaining the convolutions 59 of line 51. To pack the container 33, after such festooning of the line, the convolutions 59, with the swivel hooks 61 and 62 at each end 63 or 64, are slipped off the reel, by removing cotter pin 56, so that the closely packed elongated package of line 50 may be inserted upper end 40 first in the open, lower end 36 to fill the container and the closure 38 latched in closed position. The unitary package 50 of festoon coiled line is free of any line storage means, line support means or lashing strap means connecting it to the container 33 so that package 50 slides lower end 70 first entirely out of the open lower end 36 of the container 33 as a unitary bodily transportable package, with no part remaining anchored to the container 33.

A pig tail 60 consisting of a small length of cord having a loop at one end has the unlooped end thereof passed through the loop and around one end of the festoons of the line to form a convenient quick detachable, pull cord.

An elongated blade 65, preferably about one inch wide of resilient, flexible, thin metal, is affixed at one end 66 to the portion 44 of side wall 34 of container 33 and extends axially and linearly therealong at a spaced distance thereon, to a free terminal end 67 proximate the open end 36 of container 33. A strap 68 encircles container 33 and is affixed at 69 to the intermediate portion 71 of blade 65 to serve as a reinforcement as well as a stop when straight blade 65 is slidably inserted behind the strap 24 of the back pack 21 in the clearance 25.

An additional stop 72 may be affixed by threaded bolt means 73 in one hole 74 of a plurality of holes in the portion 71 of strap 68 to position the inverted container 33 alongside the air tank 23 with the open end 36 and handle 49 of first latch means 45 in easy reach of the hands 28 of a fireman 20 and at about the level of the small of the back and the bottom of the tank. The stop 72 is on the inside face 75 of blade 65 and the lateral projection 76 of the stop may rest on the upper edge of strap 24 at the selected height for optimum balance and access. The straight blade 65 inserted between strap 24 and the air tank 23 prevents the container 33 becoming inverted, tilted or up-ended in the event that the fireman leans over, thus keeping the bottom closure 38, and the latch handle 49, always in reach of the hands of the fireman.

Second latch means 77 is preferably provided comprising a laterally projecting ear 78 received in a slot 79 in the end 67 of blade 65, the ear 78 being affixed to side wall 34 in the lower portion 46 proximate the open end 36. The laterally projecting ear 78 has a hole 81 in which the straight leg 82 of a cotter pin 83 may be inserted, the undulated leg 84 extending outside the ear to resiliently retain the pin.

It will be seen that in operation the inverted container 33, carried alongside the tank 23 of the same back pack, assures that a line will always be available to a fireman in a burning building. Also that by reaching behind his back and releasing first latch means 45, the closure 38 will spring open, the pig tail 60 will fall out by gravity, so that it can be grasped and the festoon coiled rope withdrawn slidably as a package with no danger of entanglement of the convolutions 59. The endwise downward movement of the entire unitary package 50 into the hands of the fireman, with no part of the line remaining anchored to the container, makes the line instantly and simultaneously available to be thrown down from a window to haul up a hose without unfastening lashing straps, unreeling, detaching or untangling the line.

I claim:

1. In combination with a back frame having a cylindrical air tank retained thereon by at least one strap partially encircling said tank midway of the height thereof;

a life line carrier for firemen said carrier comprising:

an elongated hollow container having a closed, upper end, an opposite open lower end and a side wall;

an end closure hinge pivoted to said container for closing said lower open end;

spring means, operably connected to said end closure and biasing said closure to open position;

first latch means, including a handle, on said container for retaining said spring biased end closure in closed position over said open end until manually unlatched;

an elongated line closely packed within said container, as a festoon coiled, elongated unitary package; said line being accessible proximate said open end and adapted to be slidably withdrawn as a unitary package endwise from said lower end of said container when said closure is opened;

a pig tail encircling the adjacent loops at the lower end of said festooned, close packed line proximate said open end and having a portion adapted to project from said container when said closure is opened for slidably withdrawing said package;

an elongated straight blade having one end fixed to the side wall of said container, proximate said closed upper end, said blade extending in substantial parallelism with said side wall at a spaced distance therefrom toward the open end thereof to a free terminal end and second latching means on said side wall releasably connecting said free terminal end of said blade to said side wall, proximate said open lower end, said straight balde being slidable downwardly between the tank strap and the air tank of a conventional back carried air tank to position said life line carrier alongside said tank and actuation of said handle springing open said closure to permit slidable withdrawal endwise of said closely packed line as a unitary package.

2. A life line carrier as specified in claim 1 wherein:

said side wall of said container is a hollow cylinder;

said end closure is circular and said circular end closure includes a plurality of apertures for venting said container.

3. A life line carrier as specified in claim 1 wherein:

said second latching means includes an ear fixed to said side wall and projecting therefrom, said ear having a hole therein;

a slot in the terminal end of said blade adapted to receive said ear and a cotter pin having a straight leg inserted in said hole to restrain said blade and having an undulatd leg to restrain said pin.

4. A life line carrier as specified in claim 1 wherein:

said elongated straight blade includes a plurality of spaced holes therealong and a laterally extending stop removably affixed in one of said holes midway of the inside face thereof for supporting said container at a predetermined height relative to a strap behind which said blade is slid.

5. In combination with a back frame having a cylindrical air tank retained thereon by at least one strap partially encircling said tank midway of the height thereof;

an elongated, container having a side wall, a closed upper end, an open lower end, an openable closure normally covering said open lower end and an elongated line slidably packed in a festoon package within said container;

an elongated straight blade having an upper end fixed to said side wall, an intermediate portion positioned between said air tank and said air tank strap, and a lower free terminal end releasably affixed to said side wall, said elongated container being carried in parallelism with said tank with its openable closure substantially at a level of the lowermost part of the tank and within reach of the hands of a fireman wearing said back frame and a handle actuatable latch for opening said closure to permit slidable withdrawal of said elongated festoon package of line simultaneously as a unit.

6. A life line carrier for use by firemen, said carrier comprising:

an elongated hollow cylindrical container having a side wall; a closed upper end; an open lower end and a hinge pivoted closure, covering the lower end;

spring means biasing said closure to open position;

a life line festoon coiled into a package, slidably withdrawable from said open lower end, first latching means for retaining said closure in closed position;

an elongated straight blade having one end fixed to said side wall proximate the closed end of said container and extending in parallelism with said side wall to a terminal end second latching means on said side wall connecting the terminal end of said blade to said side wall and a handle for actuating said first latching means to slidably release said package of line.

7. The method of making a life line quickly available to a fireman carrying an air tank pack on his back said method comprising the steps of:

festoon coiling said line into an elongated unitary package within an elongated container having a lower end from which said line may be withdrawn supporting said container in vertical position alongside said air tank; with said lower end down at the level of the small of the back of the fireman and releasing said line from said elongated container through said lower end simultaneously as a unitary package.

8. A fireman's life line carrier comprising:

an elongated hollow tubular container having a closed upper end; an open lower end and an openable closure over said lower open end;

an elongated line festoon coiled tightly within said container as an elongated unitary package, said line having a swivel hook at each end and having a pig tail readily accessible at the open lower end of said container for withdrawing said package simultaneously as a unit;

a straight blade having one end fixed to said container proximate said closed upper end and having an opposite free terminal end, said straight blade being adapted to support said container with its open lower end down when slid behind other equipment of a fireman for preventing the container from becoming inverted, tilted or up-ended when the fireman leans over and latching means, including a handle, for opening the closure over said open lower end to enable slidable, endwise withdrawal of said festoon coiled package simultaneously as a bodily transportable unit.

* * * * *